US005971868A

United States Patent [19]

Kosmatka

[11] Patent Number: 5,971,868

[45] **Date of Patent: *Oct. 26, 1999**

[54] CONTOURED BACK SURFACE OF GOLF CLUB FACE

[75] Inventor: John B. Kosmatka, Carlsbad, Calif.

[73] Assignee: Callaway Golf Company, Carlsbad, Calif.

[ * ] Notice: This patent is subject to a terminal disclaimer.

[21] Appl. No.: 08/972,561

[22] Filed: Nov. 18, 1997

Related U.S. Application Data

[63] Continuation-in-part of application No. 08/735,601, Oct. 23, 1996, Pat. No. 5,830,084.

[51] Int. Cl.[6] ..... A63B 53/04

[52] U.S. Cl. ..... 473/349; 473/324

[58] Field of Search ..... 473/324, 349, 473/350, 345, 330

[56] References Cited

U.S. PATENT DOCUMENTS

| | | |
|---|---|---|
| Re. 34,925 | 5/1995 | McKeighen . |
| 3,858,886 | 1/1975 | Cosby . |
| 4,213,613 | 7/1980 | Nygren . |
| 4,214,754 | 7/1980 | Zebelean . |
| 4,432,549 | 2/1984 | Zebelean . |
| 4,489,945 | 12/1984 | Kobayashi . |
| 4,511,145 | 4/1985 | Schmidt . |
| 4,957,294 | 9/1990 | Long . |
| 5,028,049 | 7/1991 | McKeighen . |
| 5,060,951 | 10/1991 | Allen . |
| 5,064,197 | 11/1991 | Eddy . |
| 5,074,563 | 12/1991 | Gorman . |
| 5,280,911 | 1/1994 | Katayama . |
| 5,292,129 | 3/1994 | Long et al. . |
| 5,333,872 | 8/1994 | Manning et al. . |
| 5,344,140 | 9/1994 | Anderson . |
| 5,346,216 | 9/1994 | Aizawa . |
| 5,362,047 | 11/1994 | Shaw et al. . |
| 5,362,055 | 11/1994 | Rennie . |
| 5,377,985 | 1/1995 | Ohnishi . |
| 5,405,136 | 4/1995 | Hardman . |
| 5,405,137 | 4/1995 | Vincent et al. . |
| 5,411,255 | 5/1995 | Kurashima et al. . |
| 5,417,419 | 5/1995 | Anderson et al. . |
| 5,419,559 | 5/1995 | Melanson et al. . |
| 5,429,365 | 7/1995 | McKeighen . |
| 5,447,307 | 9/1995 | Antonious . |
| 5,464,217 | 11/1995 | Shenoha et al. . |
| 5,474,296 | 12/1995 | Schmidt et al. . |
| 5,482,279 | 1/1996 | Antonious . |
| 5,489,094 | 2/1996 | Pritchett . |
| 5,494,281 | 2/1996 | Chen . |
| 5,505,453 | 4/1996 | Mack . |
| 5,547,194 | 8/1996 | Aizawa et al. . |
| 5,562,551 | 10/1996 | Rife . |
| 5,601,501 | 2/1997 | Kobayashi . |
| 5,611,742 | 3/1997 | Kobayashi . |

*Primary Examiner*—Raleigh W. Chiu
*Attorney, Agent, or Firm*—Lyon & Lyon LLP

[57] ABSTRACT

A contoured back surface of a golf club face is shown and described along with a method for its design. The preferred back surface comprises a surface with varying thicknesses such that regions of the face which experience an approximately similar load due to application of a certain force (e.g. at least one ball impact) have an approximately similar thickness to result in a golf club face in which the stress is approximately uniform upon application of a similar force. In a preferred embodiment regions experiencing the most internal load due to a given applied force are thickest, regions experiencing lower internal load due to the same applied force are thinner, and the regions experiencing the lowest magnitude of internal load due to the same applied force are thinnest (i.e. the thickness of a region corresponds to the expected or measured applied load of that region, so that the load produced stress levels are below the material allowable stress level). The thicknesses of the preferred contoured surface may be gradual from thickness to thickness or may be stepped. In a stepped surface embodiment cracking potential along step edges is reduced by incorporating additional material at those edges so the applied load is well tolerated.

26 Claims, 4 Drawing Sheets

CONTOURED BACK SURFACE OF GOLF CLUB FACE

RELATED APPLICATION INFORMATION

This application is a continuation-in-part of U.S. patent application Ser. No. 08/735,601 filed Oct. 23, 1996, now U.S. Pat. No. 5,830,084, the disclosure of which is hereby incorporated by reference as if fully set forth herein.

FIELD OF INVENTION

The present invention relates to golf clubs, particularly to a golf club face which has a contoured surface opposite its hitting surface (i.e. a contoured backside).

BACKGROUND

Generally, a golf club comprises a shaft portion, a head portion, and a grip portion. That part of the golf club head portion which comprises a hitting surface is called a golf club face. See, e.g., R. Maltby, "Golf Club Design, Fitting, Alteration & Repair" (4th Ed. 1995). Generally, a golf club face abuts or is adjacent to both a top wall or crown of the club head and a bottom wall or sole of the club head. Typically, "crown" and "sole" are used to designate the top portion and bottom portion of a wood-type club head, and "top wall" and "bottom wall" are used to designate the top portion and bottom portion of an iron-type club head as well as a wood-type club head, and will be so used throughout the present specification.

In both wood-type club heads (which today are typically hollow, but are not necessarily so (e.g., may be foam filled)) and cavity back iron-type club heads the golf club faces are preferably thin. Such golf club faces generally define two surfaces: a hitting surface (i.e. front side) and a surface which is opposite the hitting surface (i.e. a backside).

When the front side of a face of a golf club head strikes a golf ball, large impact forces (e.g. up to 2000 pounds) are produced. These large impact forces load the club face. In the relatively thin faces of wood-type club heads and cavity back iron-type club heads these forces tend to produce large internal loads, such as, for example, large bending stresses. These internal loads may cause catastrophic material cracking which causes the club head to be unusable. The phrase "internal load" is used throughout the present specification to refer to, for example, the bending moments, shear forces, and axial forces experienced by a golf club face as the result of an applied force (e.g. at least one ball impact).

Recent computational and experimental studies on wood-type club heads and cavity back iron-type club heads have shown that catastrophic material cracking due to large internal loads (i.e. due to an applied force) most often occurs in at least one of the following three face locations: (1) in the club face hitting surface (front side) at the ball strike center which is an area of large compressive bending stresses, particularly in the area of any score-lines; (2) in the club face back surface (back side) at the ball strike center which is an area of large tensile bending stresses; and (3) (a) at the portion of the intersection of the face and the top wall which lies directly above the ball strike center which is an area of a large vertical component of the bending stresses, and/or (b) the intersection of the face and the bottom wall which lies directly below the ball strike center which also is an area of a large vertical component of the bending stresses. The area between the face/top wall intersection region (i.e. where the face and top wall meet) above the ball strike center and the face/bottom wall intersection region (i.e. where the face and bottom wall meet) below the ball strike center may be called a ball strike zone.

It has also been found that the vertical stress distribution through the ball strike zone on the back side of the face comprises large compressive (i.e. negative) applied stresses in the face/bottom wall intersection region which increase to zero toward the ball strike center region, reach a maximum tension (i.e. positive) value behind the ball strike center region, and decrease through zero to large compressive (i.e. negative) applied stresses toward the face/top wall intersection region. The vertical stress distribution through the ball strike zone on the front side (or hitting surface) of the face generally has the same, but opposite, components (i.e. large tension bending applied stresses at face/bottom wall intersection which decrease to large compressive applied stresses at ball strike center and then increase to large tension bending applied stresses at face/top wall intersection).

In designing golf club heads, the golf club face portion must be structurally adequate to withstand large repeated forces such as those associated with ball impact. Such structural adequacy may be achieved by increasing the face portion stiffness so that the load produced internal stresses are below the critical stress levels of the material used in the face. Typically, the face portions of club heads are stiffened by uniformly increasing the thickness of the face portion and/or by adding one or more ribs (i.e. discrete attached posts or lines) to the back surface of the face.

Uniformly increasing the thickness of the face portion typically requires the addition of a large amount of material to adequately reduce the internal load sufficient to prevent impact and/or fatigue cracking (i.e. to adequately withstand or tolerate the applied force, e.g., ball impact). However, the addition of such a large amount of material to a club face generally adversely affects the performance of a club incorporating such a face. The club performance is adversely affected by the overly heavy club face. In addition, the feel of a club incorporating such a face is also adversely affected by the large number of vibrations transmitted through the club. Furthermore, if a maximum club head weight were imposed, a face with added material prohibits distribution of that weight to other areas of the head where it may be preferred (i.e. more weight on the face means less weight, for example, along the perimeter of a cavity back iron-type club head).

Adding ribs to the back surface of a face to stiffen the face has the benefit of stiffening without adding a significant amount of weight to the face, but has the detrimental result of creating an irregular stiffness distribution on the face hitting surface. Examples of ribs which have been used in prior golf club head designs include, for example, vertical ribs, horizontal ribs, curved ribs, dendritic ribs, angled or skewed (i.e. V or X patterned) ribs, circular ribs, or a combination of more than one of these types. Such ribs are generally geometrically characterized as having a narrow width, any desired length, and a sufficient depth or thickness to locally increase the face stiffness and yet minimize the increase in face weight.

In addition, such ribs are typically shaped such that a sharp corner (or a curved corner with a small radii) is formed between a rib and the face back surface where the rib is attached. Such corners lead to cracking potential as they create stress focus points. Furthermore, the use of ribs which are positioned to run vertically along the face back surface cause the large bending applied stresses (which were described above) to travel to the face/bottom wall intersection and face/top wall intersection thereby increasing cracking at those positions.

Additional problems experienced with the use of ribs on a face back surface are in the manufacture of such faces. Typically faces are formed using a casting process. It is more difficult to cast faces which include rib structures due to nonuniform material shrinkage which occurs during cool-down of such a casting. Such non-uniform cool-downs tend to cause inclusions, internal voids, and/or surface cracking in the cast materials, particularly along regions where ribs are positioned. Such non-uniform cool-downs also tend to cause face depressions and surface dimpling in the hitting surface opposite the regions where ribs are positioned.

Thus, there is a need for a new club face structure with increased structural integrity (and, thereby, reduced cracking and material failure) without adversely affecting club performance, look, and feel; and with limited affect on desired club head weight distribution.

SUMMARY OF THE INVENTION

The present invention comprises a contoured golf club face which addresses the problems previously described and a method of designing such a golf club face. The present contoured golf club face provides increased structural integrity for a golf club face of a given size and weight. The present contoured golf club face survives tests in which other club faces experience cracking and/or material failure. The present contoured golf club face does not adversely affect golf club performance, look, feel, or weight distribution, but rather improves the same due to its ability to provide a golf club face having a required size and strength with a smaller amount of material (and, accordingly, a lower weight).

The present contoured golf club face preferably comprises a golf club face having a hitting surface and a contoured back surface opposite the hitting surface. Such a contoured back surface could also be described as a surface of increasing and decreasing thickness having the appearance of steps or, in another embodiment, a surface of gradually increasing and decreasing thicknesses having the appearance of rounded hills and valleys.

In a preferred embodiment, the contoured back surface comprises a stepped surface with varying thicknesses such that regions of the face which experience an approximately similar level of internal load due to a certain applied force (e.g. ball impact) have an approximately similar thickness. It is further preferred that regions where the internal load is greatest are thickest and that regions where the magnitude of the internal load is lowest are thinnest (i.e. the thickness of a region generally corresponds to the magnitude of internal load expected to be or measured as being experienced by that region).

In addition, although the preferred embodiment includes steps between regions of different thickness and, as is noted above, although sharp corners, in general, create stress focus points which provide cracking potential, it is preferred that the present invention compensate for such cracking potential by incorporating additional material at the step edges to reduce the internal load and, hence, reduce cracking potential at those edges.

In another embodiment, the contoured back surface comprises a contoured surface with different regions having different thicknesses following the thickness to internal load correlation as described above, but wherein there is a gradual increase or decrease of thicknesses between neighboring regions (i.e. as opposed to a strict stepped increase or decrease).

It is noted that the particular expected or measured internal load pattern of any given club face will depend on the location of the applied force (e.g. ball impact) on that club face, and, therefore, the thickness of the contours or regions of the surface will also so depend.

Since a golf tee is typically used when hitting a golf ball with a driver-type club, ball impact for a club head of such a club might be expected to follow a classic bell curve distribution along a central horizontal axis of the hitting surface of the club head. Iron-type clubs, on the other hand, are typically used when hitting a ball resting on the ground, and, therefore, ball impact might be expected to be more evenly distributed across the club face along a lower horizontal axis. In addition, low handicap golfers might be expected to more consistently make ball impact along the same lower horizontal axis at or near the intersection of that axis and a central vertical axis.

Thus, for a preferred embodiment of an iron-type club head for a mid- to high-handicap golfer the contoured back surface preferably comprises a stepped surface which follows an internal load pattern evenly distributed along a low horizontal axis of the club face. For example, the contoured back surface may preferably comprise a stepped surface with varying thicknesses such that the club face generally thins at the face/top wall intersection region approaching the toe and at the face/top wall intersection region approaching the heel. In this embodiment, the contours are generally defined by a vertical stiffening region and a horizontal stiffening region providing a modified "T" design on the face back surface (e.g. wherein the horizontal cross-bar of the "T" lies along the face proximate the face/bottom wall intersection region of the face and the vertical upright of the "T" lies along a central vertical axis of the face).

The horizontal stiffening region of this embodiment preferably is generally located along a horizontal axis located along the face proximate the face/bottom wall intersection region of the back surface and has a certain preferable thickness which preferably steps down to reduced thickness (i.e. becomes thinner) toward the toe and heel regions of the club head. The vertical stiffening region of this embodiment preferably is generally located along a vertical central axis of the back surface and has a certain preferable thickness which preferably steps down to reduced thickness (i.e. becomes thinner) toward the face/top wall intersection region.

The horizontal and vertical stiffening regions preferably define a thickest region at the intersection of the vertical stiffening region and the horizontal stiffening region (i.e. an area approximately located at the intersection of the vertical central axis and the face/bottom wall intersection region), and thinnest regions approximately at the face/top wall intersection region at or approaching the toe and at the face/top wall intersection region at or approaching the heel. The thickest region is adjacent to progressively thinner regions which gradually step down in thickness to the thinnest regions thereby providing a contoured surface.

In another preferred embodiment, the contoured back surface preferably comprises a stepped surface which, at a minimum, generally follows the thickness to internal load relation as set forth above, and which has regions whose thicknesses are further augmented for aesthetic purposes.

In yet another preferred embodiment, the contoured back surface preferably comprises a surface which follows the thickness to internal load relation as set forth above wherein the thicknesses of neighboring regions gradually increase and decrease from one to the other (e.g., a smooth contoured surface resembling hills and valleys).

The benefit of a contoured golf club face of the present invention is that for a given size club face its stress distribution is more even, its stiffness is more uniform, and its structural integrity is increased while its weight is reduced. An additional benefit of such a contoured golf club face is that a golf club head incorporating such a face will have certain acoustical properties depending on the design of the contoured surface.

It is, therefore, a primary object of the present invention to provide a new golf club face which provides increased strength and integrity with reduced weight and materials for a given size club face and a method of designing the same.

It is an additional object of the present invention to provide a golf club face which is contoured to provide a golf club face having varying thickness according to expected or measured internal load due to an applied force, and a method of designing the same.

It is a further object of the present invention to provide a golf club face which is contoured to provide thicker regions at areas of expected larger magnitudes of internal load and thinner regions at areas of expected lower magnitudes of internal load, wherein the thinnest regions are adjacent to progressively thicker regions which gradually thicken to the thickest regions.

It is still a further object of the present invention to provide a golf club face which is contoured to provide thickest regions at areas of expected largest magnitude of internal load and thinner regions at areas of expected lower magnitude of internal load, wherein the thinnest regions are adjacent to progressively thicker regions which step up in thickness to the thickest regions.

It is another object of the present invention to provide a structurally stiff club face which is resistant to impact deformation and a method of designing the same.

It is still another object of the present invention to provide a low-weight golf club face with overall lower impact induced stresses (i.e. due to an applied force such as ball impact) and which is more resistant to initial and long-term failures and a method of designing the same.

Other objects and features of the present invention will become apparent from consideration of the following description taken in conjunction with the accompanying drawings.

DETAILED DESCRIPTION OF THE PREFERRED EMBODIMENT

As is described above, a preferred embodiment of the present invention comprises a contoured back surface of a golf club face wherein the back surface comprises a surface having varying thicknesses such that regions of the face which are expected to experience an approximately similar level of internal load have an approximately similar thickness, such that regions expected to experience the highest magnitude of internal load are thickest and regions expected to experience the lowest magnitude of internal load are thinnest, such that the thickest regions are adjacent to progressively thinner regions to form a contoured surface, and such that the stress expected to be experienced by the contoured face upon ball impact is more evenly distributed than if the face were not contoured. The present specification shows and describes several embodiments of the present invention wherein like elements are referred to with like reference numbers.

Figure 1A:
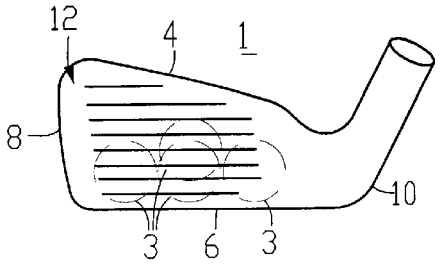
FIG. 1A shows an exemplary face of an iron-type golf club head with ball impact sites shown in phantom which might be expected from a mid- to high-handicap golfer (i.e. a golfer who would be expected to hit a number of toe, heel, and center shots).
Figure 1B:
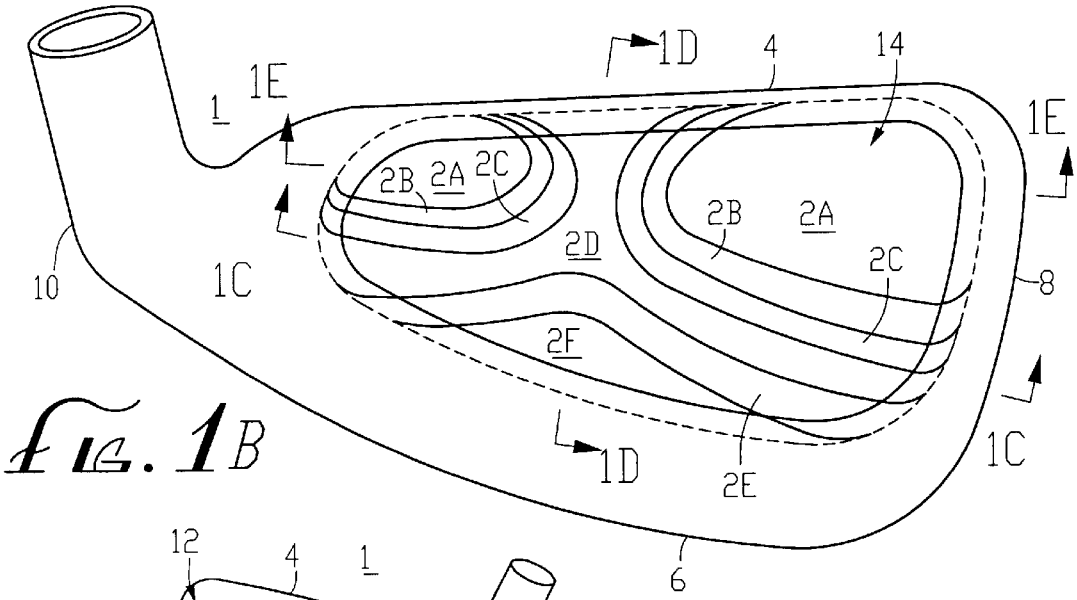
FIG. 1B shows a preferred thickness distribution as seen on the cavity back surface of the exemplary golf club face shown in FIG. 1A based on computationally calculated internal load levels experienced by the golf club face when subjected to multiple ball impact forces at the sites indicated in FIG. 1A, with a portion of the back surface shown in phantom as extending to undercut portions of the cavity.

The golf club head 1 of the preferred embodiment shown in FIGS. 1A and 1B has a top wall 4, a bottom wall 6, a toe 8, a heel 10, and a face comprising a ball hitting surface 12 (FIG. 1A) and a contoured back surface 14 (FIG. 1B) opposite the ball hitting surface 12. While the present drawings all show a cavity back iron-type golf club head, it should be understood that the present invention is equally applicable to other types of golf club heads including, for example, wood-type golf club heads.

Figure 1C:
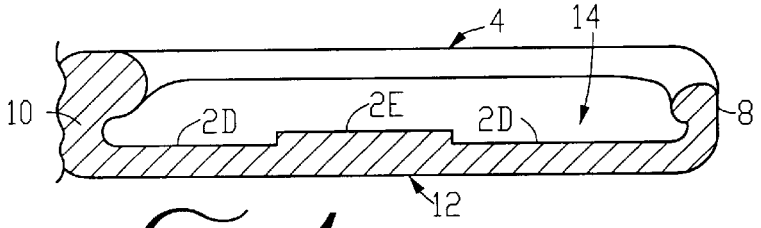
FIG. 1C shows a cross-sectional view of the golf club face of FIG. 1B taken along a central horizontal axis shown as line 1C—1C in FIG. 1B.
Figure 1D:
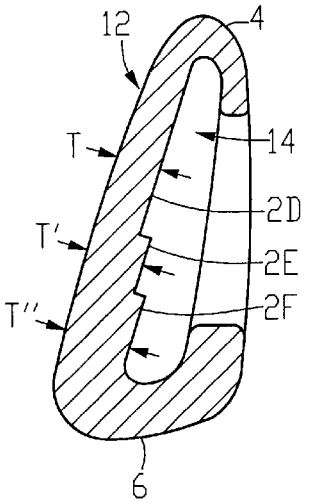
FIG. 1D shows a cross-sectional view of a golf club face of FIG. 1B taken along a central vertical axis shown as line 1D—1D in FIG. 1B.
Figure 1E:
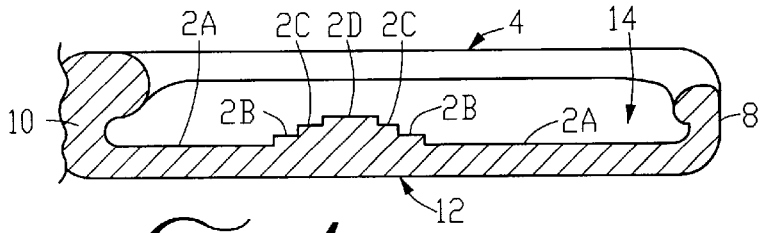
FIG. 1E shows a cross-sectional view of a golf club face of FIG. 1B taken along a high horizontal axis shown as line 1E—1E in FIG. 1B.

As is shown in FIGS. 1A, 1C and 1D, the front ball hitting surface 12 may include score-lines (FIG. 1A), and the back surface 14 is contoured and preferably comprises regions 2*a*–2*f* having varying thicknesses. The back surface 14 may optionally include an area 18 for accommodating an insignia, logo, or medallion, an example of which is shown in phantom in FIG. 4A described below.

In a preferred embodiment, for example, FIG. 1A shows a golf club face 1 of an exemplary iron-type golf club head with ball impact sites 3 shown in phantom which might be expected from a mid- to high-handicap golfer (i.e. a golfer who would be expected to hit a number of toe, heel, and center shots). FIG. 1B shows a thickness distribution seen on the back surface 14 of the golf club face 1 based on computationally calculated internal loads (i.e., bending moments, shear forces, and axial forces) experienced by the golf club face 1 when subjected to multiple ball impact forces at the sites 3 shown in FIG. 1A. It should be noted that similar calculations could be made using just one ball impact site or multiple impact sites at locations different from those shown.

As shown in FIGS. 1B–1E: region 2*f* is thickest as it is expected to experience greatest internal load due to ball impact at sites 3 (shown in FIG. 1A), regions 2*a* are thinnest as they are expected to experience the lowest magnitude of internal load due to the same ball impact, and regions 2*b*, 2*c*, 2*d*, and 2*e* gradually increase in thickness respectively as they are respectively expected to experience, from the same ball impact, internal loads which gradually increase in intensity between that experienced by the two regions 2*a* to that experienced by region 2*f*. Thus, the contoured back surface 14 preferably comprises a plurality of regions 2*a*–2*f* of varying thicknesses such that the club face generally thins at the face/top wall intersection region approaching the toe 8 and at the face/top wall intersection region approaching the heel 10, and wherein the thickness of the regions 2*a*–2*f* generally corresponds to the internal load expected to be experienced by each region 2*a*–2*f* upon multiple ball impacts at sites 3 shown in FIG. 1A. The thicknesses of the regions 2*a*–2*f* result in relatively even distribution of stress across the face when the club head 1 impacts a ball at, near, or similar to the sites 3 used in the initial analysis.

It should be noted that the embodiments of the present invention shown and described here lump together regions which are expected to experience approximately similar magnitudes of internal load to form each region, but that those skilled in the art would understand that many more (or fewer) regions than are shown here could be defined using the present invention.

Figure 3:
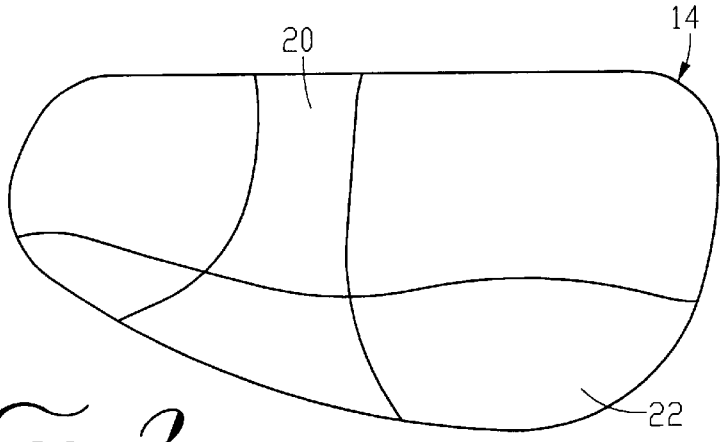
FIG. 3 shows a plan view of a back surface of a preferred embodiment of an iron-type golf club face of the present invention generally showing outlines of vertical and horizontal stiffening regions.

The contoured regions 2*a*–2*f* generally follow along a vertical stiffening region 20 and a horizontal stiffening region 22, both shown in FIG. 3, which approximately provide a modified up-side-down "T" design on the face back surface 14 (e.g. wherein the cross-bar of the "T" lies along the face/bottom wall intersection region and the upright of the "T" lies along a central vertical axis). The horizontal stiffening region 22 preferably is generally located along a horizontal axis laying along the face/bottom wall intersection region of the back surface 14 and has a certain preferable thickness which preferably thins toward the toe 8 and heel 10 of the club head 1. The vertical stiffening region 20 preferably is generally located along a vertical central axis of the back surface 14 and has a certain preferable thickness which preferably thins toward the face/top wall intersection region proximate the top wall 4.

The horizontal stiffening region 22 and vertical stiffening region 20 preferably define a thickest region 2*f* (see FIGS. 1B, 1C and 1D) approximately at the intersection of the vertical stiffening region 20 and the horizontal stiffening region 22 (i.e. an area approximately located at the intersection of the vertical central axis and the face/bottom wall intersection region), and thinnest regions 2*a*, 2*b*, and 2*c* (see FIG. 1B and 1E) approximately at the face/top wall intersection region approaching the toe 8 and at the face/top wall intersection region approaching the heel 10.

As is shown in FIG. 3, the vertical stiffening region 20 preferably is generally located substantially along a vertical central axis of the back surface 14 and, as shown in FIG. 1D, has a certain preferable thickness T which steps up (i.e. thickens) to a certain preferable thickness T' and then to another preferable thickness T". Also shown in FIG. 3, the horizontal stiffening region 22 preferably is generally located along a portion of the back surface 14 proximate to the face/bottom wall intersection region and, similar to that shown in FIG. 1C, has a certain preferable thickness which preferably steps down to thinner thicknesses toward extremities of the horizontal stiffening region 22 (i.e. toward the toe and heel regions).

As is mentioned above and shown in FIGS. 1B and 1D, the horizontal stiffening region 22 and the vertical stiffening region 20 preferably define a thickest region 2*f* at their intersection, and thinnest regions 2*a*, 2*b*, and 2*c* (i.e. approximately at the face/top wall intersection region at or approaching the toe 8 and approximately at the face/top wall intersection region at or approaching the heel 10). As is also mentioned above and shown in FIGS. 1B–1E, the thickest region 2*f* is preferably adjacent to progressively thinner regions 2*e* and 2*d* which gradually step down in thickness to the thinnest regions 2*a*, 2*b*, and 2*c* thereby providing a contoured surface. While the regions 2*a*–2*f* are stepped from thickness to thickness and, as is noted above, while step edges, in general, create stress focus points which provide cracking potential, it is preferred that the present invention compensate for such cracking potential by incorporating sufficiently thick material to withstand the internal load expected to be experienced at the step edges (i.e. at the borders between each region 2*a*, 2*b*, 2*c*, 2*d*, 2*e*, and 2*f*) upon application of an external force (i.e. ball impact) so the applied load is well tolerated at those edges.

Exemplary specific thicknesses for regions 2*a*–2*f* of the embodiment shown in FIGS. 1A and 1B for a club face made of steel are: regions 2*a* are approximately about 0.07 inches; regions 2*b* are approximately about 0.08 inches; regions 2*c* are approximately about 0.09 inches; region 2*d* is approximately about 0.10 inches; region 2*e* is approximately about 0.12 inches; and region 2*f* is approximately about 0.14 inches. Exemplary specific width and height for such a club face are a width of between about 3.0 and 4.0 inches as measured along a horizontal central axis of the club face, and a height of between about 1.5 and 2.0 inches as measured along a vertical central axis of the club face. However, those of ordinary skill in the art understand that to provide club faces with similar structural integrity and performance, the thicknesses and dimensions of the club faces will differ from these exemplary values depending on the materials (e.g. metals, alloys, etc.) used and the physical properties of the same, and the particular size and shape of the desired club face.

Figure 2A:
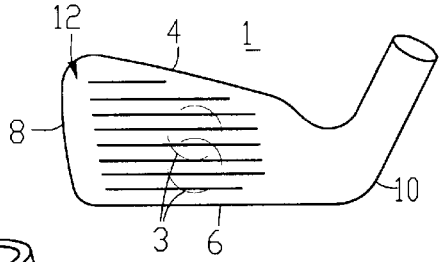
FIG. 2A shows an exemplary face of an iron-type golf club head with ball impact sites shown in phantom which might be expected from a low-handicap golfer (i.e. a golfer who would be expected to hit most shots at the center).
Figure 2B:
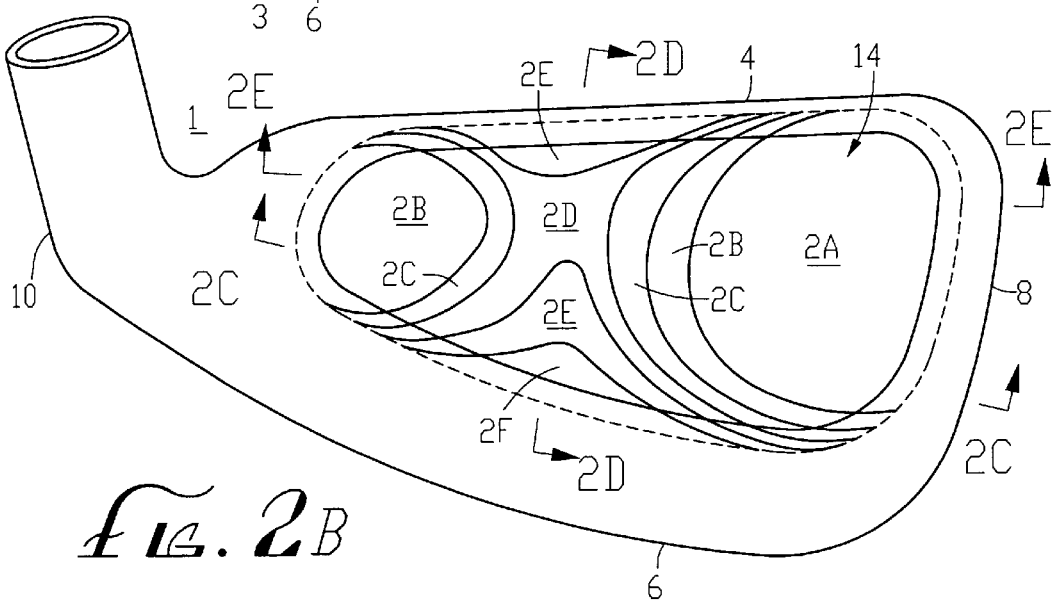
FIG. 2B shows a preferred thickness distribution as seen on the cavity back surface of the exemplary golf club face shown in FIG. 2A based on computationally calculated internal load levels experienced by the golf club face when subjected to multiple ball impact forces at the sites indicated in FIG. 2A, with a portion of the back surface shown in phantom as extending to undercut portions of the cavity.

In another preferred embodiment, FIG. 2A shows a golf club face 1 of an exemplary iron-type golf club head with ball impact sites 3 shown in phantom which might be expected from a low-handicap golfer (i.e. a golfer who would be expected to hit most shots at the center). FIG. 2B shows a thickness distribution seen on the back surface 14 of the golf club face 1 based on computationally calculated internal loads (i.e., bending moments, shear forces, axial forces) experienced by the golf club face 1 when subjected to multiple ball impact forces at the sites 3 (FIG. 2A). As is noted above, similar calculations could be made using just one ball impact site or multiple impact sites at locations different from those shown.

As with the embodiment explained above and as is shown in FIGS. 2B–2E, region 2*f* of this second embodiment is thickest as it is expected to experience the greatest magnitude of internal load due to multiple ball impacts at sites 3, regions 2*a* and 2*b* are thinnest as they are expected to experience the lowest magnitude of internal load, and regions 2*c,* 2*d,* and 2*e* gradually increase in thickness respectively as they are respectively expected to experience internal loads which gradually increase in intensity between that experienced by regions 2*a* and 2*b* to that experienced by region 2*f.*

Figure 2C:
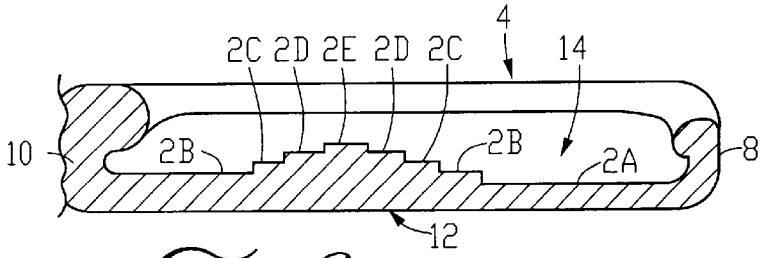
FIG. 2C shows a cross-sectional view of a golf club face of FIG. 2B taken along a central horizontal axis shown as line 2C—2C in FIG. 2B.
Figure 2D:
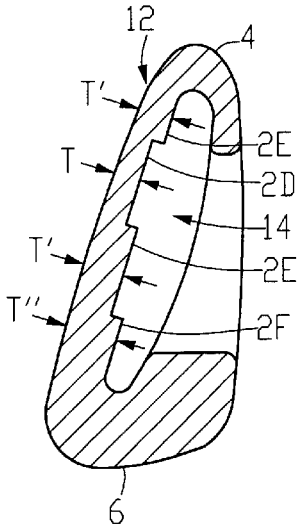
FIG. 2D shows a cross-sectional view of a golf club face of FIG. 2B taken along a central vertical axis shown as line 2D—2D in FIG. 2B.
Figure 2E:
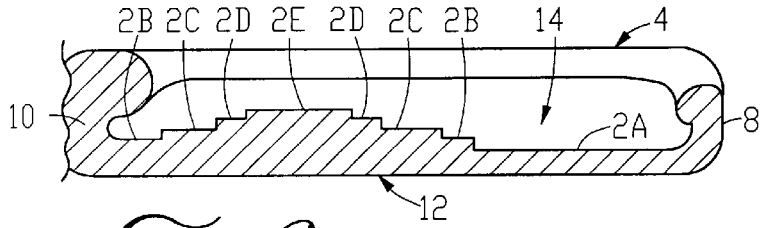
FIG. 2E shows a cross-sectional view of a golf club face of FIG. 2B taken along a high horizontal axis shown as line 2E—2E in FIG. 2B.

As with the first embodiment described above and shown in FIGS. 1A–1E, the contoured back surface 14 of this second embodiment (shown in FIG. 2B–2E) preferably comprises a plurality of regions 2*a*–2*f* of varying thicknesses wherein the thickness of each region 2*a*–2*f* generally corresponds to the magnitude of internal load expected to be experienced by each region 2*a*–2*f* due to ball impact at sites 3 (shown in FIG. 2A). This second embodiment is designed such that the club face generally thins approaching the toe 8 and approaching the heel 10 along a central horizontal axis. The contoured regions 2*a*–2*f* generally follow along a vertical stiffening region 20 and a horizontal stiffening region 22 as were described previously. However, as is shown in FIG. 2D, the vertical stiffening region 20 of the present embodiment preferably comprises a certain thickness centrally which thickens toward the face/top wall intersection region proximate the top wall 4 and further thickens toward the face/bottom wall intersection region proximate the bottom wall 6. As in the previously described embodiment, the horizontal stiffening region 22 and vertical stiffening region 20 of this embodiment preferably define a thickest region 2*f* approximately at the intersection of the vertical stiffening region 20 and the horizontal stiffening region 22 (i.e. an area approximately located at the intersection of the vertical central axis and the face/bottom wall intersection region). However, in the present embodiment thinnest regions 2*a,* 2*b,* and 2*c* (see FIG. 2B) are present approximately approaching the toe 8 and approaching the heel 10 along a central horizontal axis (as opposed to along the face/top wall intersection region as in the above-described embodiment).

In this second embodiment, the vertical stiffening region 20 preferably is generally located substantially along a vertical central axis of the back surface 14 and, as shown in FIG. 2D, has a certain preferable thickness T centrally which steps up (i.e. thickens) to a certain preferable thickness T' toward the top wall 4 and up to certain preferable thicknesses T' and T" toward the bottom wall 6. The horizontal stiffening region 22 preferably is similar to that described above for the first embodiment (i.e. has a certain thickness which steps down to thinner thicknesses approaching the toe and heel regions).

As is mentioned above and shown in FIGS. 2B–2E, the horizontal stiffening region 22 and the vertical stiffening region 20 preferably define a thickest region 2*f* at their intersection, and thinnest regions 2*a,* 2*b,* and 2*c* (i.e. at or approaching the toe 8 along a central horizontal axis and at or approaching the heel 10 along the same axis). As is shown in FIG. 2B, the thickest regions 2*e* and 2*f* are preferably adjacent to a progressively thinner region 2*d* which gradually steps down in thickness to the thinnest regions 2*a,* 2*b,* and 2*c* thereby providing a contoured surface.

While the regions 2*a*–2*f* are stepped from thickness to thickness and, as is noted above, while step edges, in general, create stress focus points which provide cracking potential, it is preferred that the present invention compensate for such cracking potential by incorporating sufficiently thick material to withstand the internal load expected at the step edges (i.e. at the borders between each region 2*a,* 2*b,* 2*c,* 2*d,* 2*e,* and 2*f*) so the applied load is well tolerated at those edges.

Exemplary specific thicknesses for regions 2*a*–2*f* of the embodiment shown in FIGS. 2A and 2B for a club face made of steel are preferably approximately as is described above for the embodiment shown in FIGS. 1A and 1B.

As with the previous embodiment described above, the thicknesses of the regions 2*a*–2*f* in this embodiment result in relatively more even distribution of stress across the face when the club head 1 impacts a ball at or near locations similar to the sites 3 used in the initial analysis.

As is also described above and as is shown in FIGS. 4A–6C, another embodiment of the present invention relates to a golf club head 1 which follows the thickness to internal load relation as set forth above, and which further includes additional material to further augment the thickness of the club face for aesthetic purposes.

As is shown in FIGS. 5A–6C, the back surface 14 of this third embodiment is contoured and preferably comprises regions 16*a*–16*h* having varying thicknesses which generally correspond to the internal load expected to be experienced by each region 16*a*–16*h*. The back surface 14 may optionally include an area 18 for accommodating an insignia, logo, or medallion, an example of which is shown in phantom in FIG. 5A.

The contoured back surface 14 of this third embodiment preferably comprises a plurality of regions 16*a*–16*h* defining varying thicknesses such that the club face generally thins at the face/top wall intersection region approaching the toe 8 and at the face/top wall intersection region approaching the heel 10. The contoured regions 16*a*–16*h* generally follow along a vertical stiffening region 20 and a horizontal stiffening region 22, as both are shown in FIG. 3, which approximately provide a modified up-side-down "T" design on the face back surface 14 (e.g. wherein the cross-bar of the "T" lies along the face/bottom wall intersection region and the upright of the "T" lies along a central vertical axis).

The horizontal stiffening region 22 preferably is generally located along a horizontal axis laying along the face/bottom wall intersection region of the back surface 14 and has a certain preferable thickness which preferably thins toward the toe 8 and heel 10 of the club head 1. The vertical stiffening region 20 preferably is generally located along a vertical central axis of the back surface 14 and has a certain preferable thickness which preferably thins toward the face/top wall intersection region proximate the top wall 4. Thus, the horizontal stiffening region 22 and vertical stiffening region 20 preferably define a thickest region 16*h* (see FIGS. 4A–4B) approximately at the intersection of the vertical stiffening region 20 and the horizontal stiffening region 22 (i.e. an area approximately located at the intersection of the vertical central axis and the face/bottom wall intersection region), and thinnest regions 16*a,* 16*b,* and 16*c* (see FIGS. 4A–4B) approximately at the face/top wall intersection region approaching the toe 8 and at the face/top wall intersection region approaching the heel 10. The thickest region 16*h* is preferably adjacent to progressively thinner regions 16*d,* 16*e,* 16*f,* and 16*g* which gradually step down in thickness to the thinnest regions 16*a,* 16*b,* and 16*c* thereby providing a contoured surface.

Figure 6B:
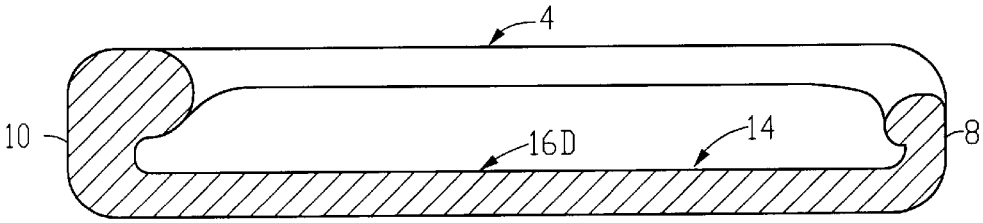
FIG. 6B shows a cross-sectional view proximate a horizontal central axis of a golf club face of the present invention taken along line 6B—6B in FIG. 4A.
Figure 6C:
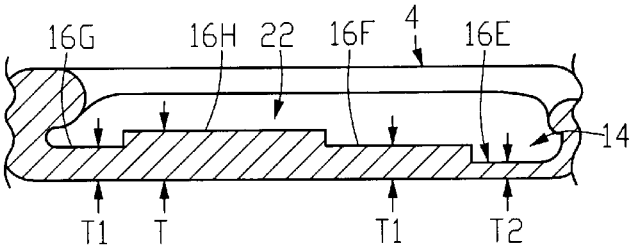
FIG. 6C shows a cross-sectional view of a horizontal stiffening region of a golf club face of the present invention taken along a low horizontal axis shown as line 6C—6C in FIG. 4A.
Figure 5A:
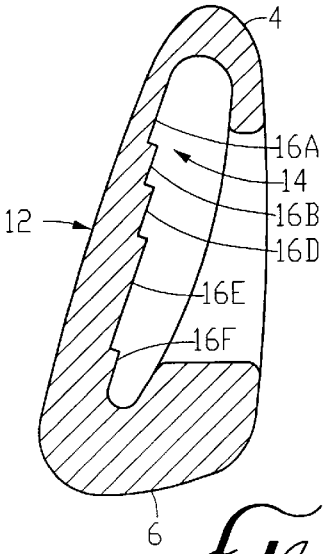
FIG. 5A shows a cross-sectional view of a golf club face of the present invention taken along a vertical axis shown as line 5A—5A in FIG. 4A.
Figure 5B:
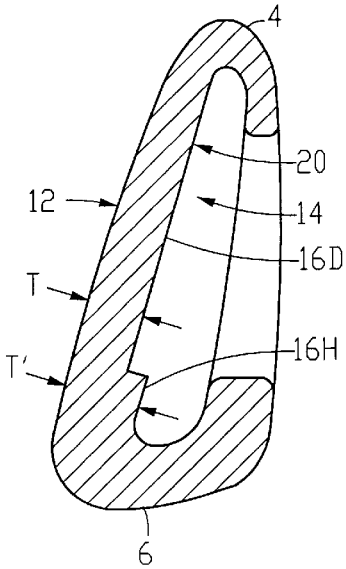
FIG. 5B shows a cross-sectional view of a vertical stiffening region proximate a vertical central axis of a golf club face of the present invention taken along line 5B—5B in FIG. 4A.
Figure 6A:
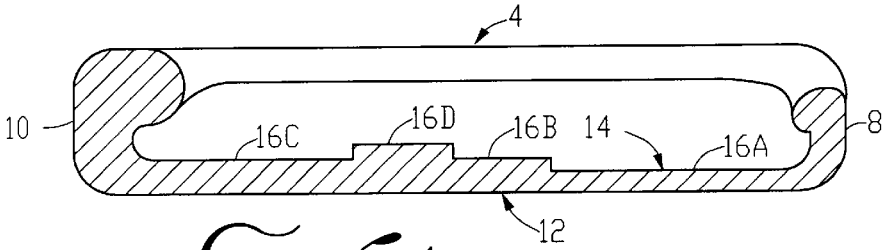
FIG. 6A shows a cross-sectional view of a golf club face of the present invention taken along a high horizontal axis shown as line 6A—6A in FIG. 4A.

As is shown in FIG. 3, the vertical stiffening region 20 preferably is generally located substantially along a vertical central axis of the back surface 14 and, as shown in FIG. 5B, has a certain preferable thickness T which steps up (i.e. thickens) to a certain preferable thickness T'. Also shown in FIG. 3, the horizontal stiffening region 22 preferably is generally located along a portion of the back surface 14 proximate to the face/bottom wall intersection region and, as shown in FIG. 6C, has a certain preferable thickness t which preferably steps down (i.e. thins) to thicknesses $t_1$ and $t_2$ toward extremities of the horizontal stiffening region 22.

As is mentioned above and shown in FIGS. 4A, 5B, and 6C, the horizontal stiffening region 22 and the vertical stiffening region 20 preferably define a thickest region 16*h* at their intersection, and thinnest regions 16*a*–16*b* (i.e. approximately at the face/top wall intersection region at or approaching the toe 8) and 16*c* (i.e. approximately at the face/top wall intersection region at or approaching the heel 10). As is also mentioned above and shown in FIGS. 4A–6C, the thickest region 16*h* is preferably adjacent to progressively thinner regions 16*d*–16*g* which gradually step down in thickness to the thinnest regions 16*a*–16*b* and 16*c* thereby providing a contoured surface. While the regions 16*a*–16*h* are stepped from thickness to thickness and, as is noted above, while step edges, in general, create stress focus points which provide cracking potential, it is preferred that the present invention compensate for such cracking potential by incorporating sufficiently thick material to withstand the internal load expected at the step edges (i.e. at the borders between each region 16*a,* 16*b,* 16*c,* 16*d,* 16*e,* 16*f,* 16*g,* and 16*h*) so the applied load is well tolerated at those edges.

Figure 4B:
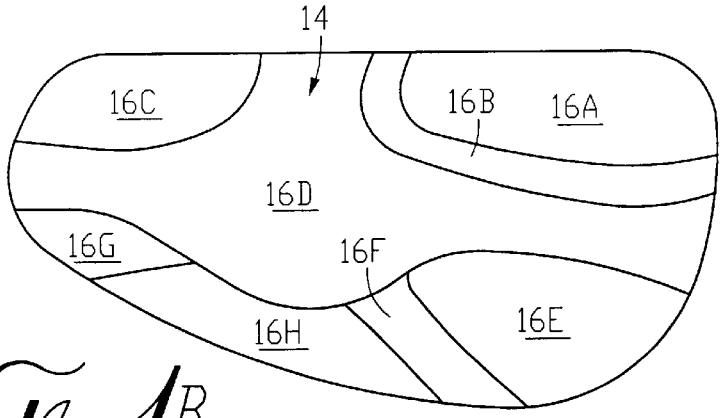
FIG. 4B shows a plan view of a back surface of a golf club face of the present invention apart from a golf club head.
Figure 4A:
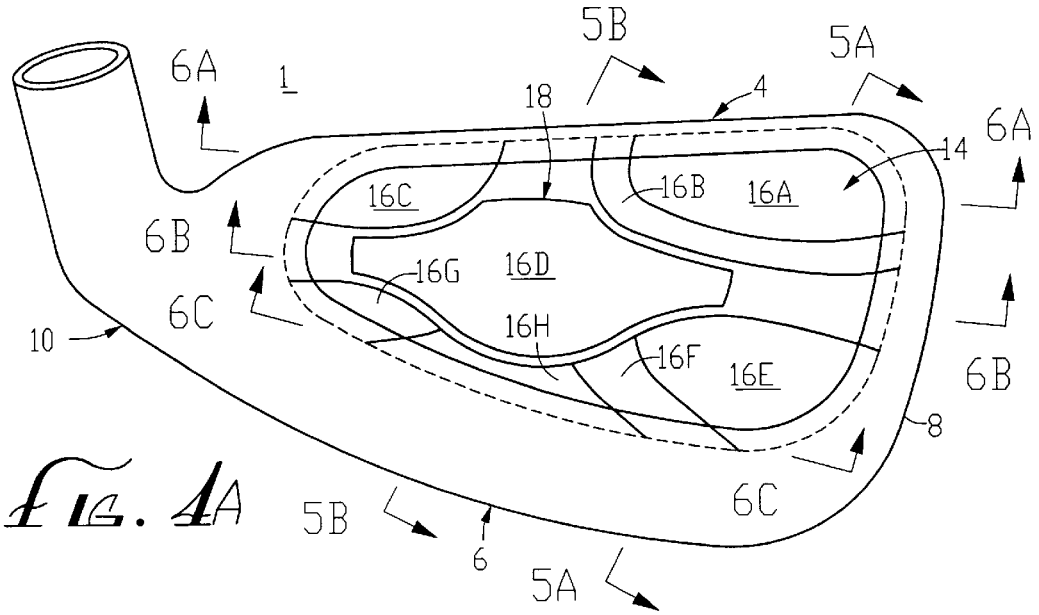
FIG. 4A shows a plan view of a back surface of a golf club face of the present invention as incorporated in a cavity back iron-type golf club head with a portion of the back surface shown in phantom as extending to undercut portions of the cavity.

Exemplary specific thicknesses for regions 16*a*–16*h* of the embodiment shown in FIGS. 4A and 4B for a club face made of steel are: (1) region 16*a* is about 0.07 inches; (2) regions 16*b* and 16*c* are about 0.09 inches; (3) region 16*d* is about 0.11 inches; (4) region 16*e* is about 0.12 inches; (5) regions 16*f* and 16*g* are about 0.13 inches; and (6) region 16*h* is about 0.14 inches. Thus, the embodiment shown meets the minimum approximate thicknesses of the preferred embodiment shown in FIGS. 1A and 1B, but augments those thickness for aesthetic purposes. Exemplary specific width and height for such a club face are a width of between about 3.0–4.0 inches as measured along a horizontal central axis of the club face, and a height of between about 1.5–2.0 inches as measured along a vertical central axis of the club face. However, those of ordinary skill in the art understand that to provide club faces with similar structural integrity and performance, the thicknesses and dimensions of the club faces will differ from these exemplary values depending on the materials used and the physical properties of the same, and the particular size and shape of the desired club face.

The exemplary embodiment of the present invention provides a structurally "efficient" golf club face having increased strength and reduced weight for a given face size. The club face design of the present invention has a significantly lower face weight than a similarly strong club face which has a uniform thickness (which is described above), thereby resulting in a club which has better playability (by allowing more freedom to distribute weight from the face to other areas of the club head). The club face design of the present invention also has a more uniform face stiffness distribution than a club face which incorporates ribs on its face back surface, as described above.

In addition, the club face design of the present invention is more structurally efficient than prior designs, thereby eliminating common structural failures and flaws associated with manufacturing such as, for example, casting, welding, and/or shrinkage. Further, the club face design of the present invention has increased structural resiliency for a given ball impact whereby, as a result of the design, the applied load is better tolerated (1) in the face hitting surface at the ball strike center, particularly in the area of any score-lines; (2) on the back surface of the club face at the ball strike center; and (3) at the face/top wall and face/bottom wall intersections which, respectively, lie directly above and below the ball strike center.

The club face design of the present invention further provides a more uniform face stiffness over a larger area thereby insuring that balls hit off-center will still experience a more uniformly stiff face surface and thereby react as if hit oncenter (i.e. a larger sweet spot or sweet spot region or region providing optimal ball travel and trajectory) and will not detrimentally affect the club face structurally.

The present design for a contoured face of the present invention was achieved by first performing a detailed computational structural analysis of the proposed head geometry for a series of different simulated ball impacts which determined the following: (1) for a central hit, the internal loads are largest in the central region and in face/bottom wall and face/top wall interface regions, whereas the internal load in the toe and heel regions are near zero; (2) for miss hits (i.e. hits off of the central region), internal loads are highest at the ball impact center and directly above and below the ball impact center at the face/top wall and face/bottom wall intersection regions; (3) effective face stiffness significantly decreases off-center due to the reduction in face width and presence of a stiff perimeter edge (i.e. there are drastic stiffness changes when hits are off of the central region); and (4) for almost all hits there were regions in which the internal load was low and, therefore, regions from which material (and weight) could be removed without adversely affecting the structural integrity of the face. The results of these studies are equally applicable to both wood-type club heads and cavity back iron-type club heads.

Based on these results and as is described above, a club face 1 of the present invention was designed to have a relatively thick central vertical stiffening region 20 (shown in FIG. 3) under the central region approximately along a central vertical axis of the club face 1 with increasing width at the face/bottom wall intersecting region (e.g. 16*h* in FIG. 4A) to insure that the internal load safely disperses into the head bottom wall region. The thicknesses T and T' (shown in FIG. 5B) of the vertical stiffening region were adjusted so that the internal load experienced in this region was below the maximum tolerable by the material.

As is also described above, the present club face was also designed to have a horizontal stiffening region 22 (shown in FIG. 3) along a horizontal axis proximate the face/bottom wall intersection region of the back surface and has a certain preferable thickness t (shown in FIG. 6C) which preferably steps down (i.e. thins) to reduced thicknesses $t_1$ and $t_2$ (also shown in FIG. 6C) toward the toe and heel regions of the club head 1. These thicknesses along the horizontal stiffening region were adjusted so that the internal load expected to be experienced in this region was below the maximum tolerable by the material.

While embodiments of the present invention have been shown and described, various modifications may be made without departing from the scope of the present invention, and all such modifications and equivalents are intended to be covered. For example, in our design the preferred stiffening regions are shown as corresponding to horizontal and vertical axes of the club face. However, in an equivalent design such stiffening regions could be based on a pattern other than one corresponding to such axes (e.g. a pattern wherein the stiffening regions are off-set from the horizontal and vertical axes or a pattern wherein the stiffening regions are not approximately perpendicular or a pattern wherein there are more than two or three main stiffening regions).

In a further example, an equivalent method would be to design a contoured club face based upon a given external force even if the resulting contours are different than that described as preferred here. Such a given external force may be, for example, the result of different predicted or known or otherwise selected or experienced ball impact patterns or even a single ball impact.

What is claimed is:

1. A method of designing a golf club face comprising the steps of:

a) identifying at least one first region of the face which has a first magnitude of internal load due to at least one ball impact at a given location, b) identifying at least one second region having a second magnitude of internal load due to said at least one ball impact at said given location wherein the second magnitude is less than the first magnitude, and c) assigning a first thickness to the first region and a second thickness to the second region which is smaller than the first thickness, such that a club face manufactured with the assigned thicknesses has a more uniform stress distribution as compared to a non-contoured face upon ball impact at a location similar to said given location.

2. The method of claim 1 wherein the first magnitude of internal load and the second magnitude of internal load are due to a plurality of ball impacts over a plurality of given locations, and wherein said club face manufactured with the assigned thicknesses has a more uniform stress distribution upon ball impact at a location similar to at least one of said given locations.

3. A method of designing a contoured golf club face comprising the step of assigning a thickness to each area of the face according to a magnitude of internal load expected to be experienced by each area when a force is exerted against a ball-hitting surface of the face at a given location wherein the assigned thickness is larger in those areas of the face which are expected to experience higher magnitude internal load when the force is exerted against the ball-hitting surface of the face and the assigned thickness is smaller in those areas of the face which are expected to experience lower magnitude internal load when the force is exerted against the ball-hitting surface.

4. The method of claim 3 wherein the magnitude of internal load expected to be experienced by each area is the result of more than one force being exerted against the ball-hitting surface of the face, and wherein said more than one force is exerted against the ball-hitting surface of the face at one or more given location.

5. A method of designing a golf club face comprising determining regions of a golf club face in which magnitudes of internal load are similar when subjected to at least one ball impact force at a given location, decreasing the thickness of those regions which experience relatively lower magnitude internal loads and increasing the thickness of those regions which experience relatively higher magnitude internal loads such that regions which experience similar magnitudes of internal loads have similar thicknesses to result in a golf club face in which the stress is approximately uniform when the face is subjected to at least one ball impact force at a location similar to said given location, and wherein the thicknesses between regions are stepped.

6. The method of claim 5 wherein said magnitudes of internal load are due to a plurality of ball impacts over a plurality of given locations, and wherein the golf club face experiences approximately more uniform stress when subjected to at least one ball impact force at a location similar to at least one of said given locations.

7. A method of designing a golf club face comprising determining magnitudes of internal loads experienced by various regions of the face when the face is subjected to at least one ball impact force at a first location and assigning similar thickness of material to areas which experience a similar magnitude of internal load such that those regions experiencing a lower magnitude of internal load are thinner than those regions experiencing a higher magnitude of internal load wherein the regions of differing thicknesses are stepped to result in a golf club face in which the internal load is approximately uniformly distributed when the face is subjected to a ball impact force at a second location which is at least similar to said first location.

8. The method of claim 7 wherein the magnitudes of internal loads are due to the face being subjected to a plurality of ball impacts over a plurality of first locations, and wherein the second location is at least similar to at least one of said plurality of first locations.

9. A golf club face comprising a ball-hitting surface, and a back surface which is opposite the ball hitting surface, wherein the back surface is contoured to give the face two or more thicknesses, wherein regions which experience a similar magnitude of internal load upon a force being placed on the ball-hitting surface have similar thicknesses, and wherein the back surface is stepped between regions of differing thickness.

10. A golf club head comprising a golf club face as in claim 9.

11. A golf club face comprising a front surface, and a back surface which is opposite the front surface, the back surface being contoured to give the face at least a first region having a first thickness and a second region having a second thickness, the first region substantially corresponding to a first area of a similarly sized and shaped non-contoured golf club face which experiences a first range of stress levels due to at least one ball impact at a location, the second region substantially corresponding to a second area of the similarly sized and shaped non-contoured face which experiences a second range of stress levels due to said at least one ball impact at said location, the first thickness being thicker than the second thickness, and the first range of stress levels being greater than the second range of stress levels.

12. The club face of claim 11 further comprising the first range of stress levels being mutually exclusive of the second range of stress levels.

13. The golf club face of claim 11 wherein approximately all regions substantially corresponding to the areas of a similarly sized and shaped non-contoured face which upon ball impact at said location experience stress levels within the first range of stress levels have the first thickness.

14. The golf club face of claim 13 wherein approximately all regions substantially corresponding to the areas of a similarly sized and shaped non-contoured face which upon ball impact at said location experience stress levels within the second range of stress levels have the second thickness.

15. The golf club face of claim 11 wherein the first range of stress levels and the second range of stress levels are due to a plurality of ball impacts at a plurality of first locations.

16. The golf club face of claim 15 wherein approximately all regions substantially corresponding to the areas of a similarly sized and shaped non-contoured face which upon ball impact at a second location which is at least similar to one of said plurality of first locations experience stress levels within the first range of stress levels have the first thickness.

17. The golf club face of claim 16 wherein approximately all regions substantially corresponding to the areas of a similarly sized and shaped non-contoured face which upon ball impact at said second location experience stress levels within the second range of stress levels have the second thickness.

18. A golf club face comprising a front surface, and a contoured back surface opposite the front surface, said contoured back surface substantially corresponding to a similarly sized and shaped non-contoured golf club face, said non-contoured face having first areas which experience stress levels within a particular range due to at least one ball impact at a location and second areas which do not experience stress levels within said particular range, wherein approximately all regions of the contoured back surface which substantially correspond to said first areas of the non-contoured face have about the same thickness.

19. The golf club face of claim 18 wherein said stress levels are due to a plurality of ball impacts at a plurality of locations.

20. A golf club face comprising a ball hitting surface, and a back surface opposite the ball hitting surface, wherein the back surface is contoured in a stepped fashion, the back surface having at least a first region and a second region, the first region experiencing a magnitude of internal load within a first range due to at least one ball impact at a location on the ball hitting surface, the second region experiencing a magnitude of internal load within a second range due to said at least one ball impact, and the first range comprising larger magnitudes than the second range, and the first region being thicker than the second region.

21. The golf club face of claim 20 wherein the magnitudes of internal load are due to a plurality of ball impacts at a plurality of locations on the ball hitting surface.

22. A golf club head comprising a golf club face as in claim 20.

23. A golf club comprising a golf club head as in claim 22.

24. A golf club face comprising a ball-hitting surface, and a back surface which is opposite the ball-hitting surface, wherein the back surface is contoured to give the face two or more thicknesses, wherein regions of the face which experience a similar magnitude of internal load upon a force being applied to the ball-hitting surface have similar thicknesses, and wherein the back surface is smoothly contoured between regions of differing thickness.

25. A golf club head comprising a golf club face as in claim 24.

26. The golf club face of claim 24 wherein the magnitudes of internal load are due to a plurality of ball impacts at a plurality of locations on the ball hitting surface.

* * * * *